US006425146B1

(12) United States Patent
O'Brien et al.

(10) Patent No.: US 6,425,146 B1
(45) Date of Patent: Jul. 30, 2002

(54) ELEVATING BATH LIFT SEAT FOR ELDERLY AND DISABLED PERSONS

(76) Inventors: John L. O'Brien, 11 Parklane Court, Gloucester, ON (CA), K1B 3H3; Edward M. Thomas, 522 Gascon St., P.O. Box 131, Russell, ON (CA), K4R 1E8; Donald A. N. Ed, 27 Pentry Lane, Ottawa, ON (CA), K1S OX1

( * ) Notice: Subject to any disclaimer, the term of this patent is extended or adjusted under 35 U.S.C. 154(b) by 34 days.

(21) Appl. No.: 09/696,977

(22) Filed: Oct. 27, 2000

(51) Int. Cl.[7] ..... A47K 3/02

(52) U.S. Cl. ..... 4/560.1; 4/564.1; 4/565.1; 4/566.1

(58) Field of Search ..... 4/560.1–566.1, 4/667

(56) References Cited

U.S. PATENT DOCUMENTS 2,725,578 A * 12/1955 Keller ..... 4/565.1
3,256,036 A * 6/1966 Nolan ..... 4/564.1
3,271,791 A * 9/1966 Sarff ..... 4/562.1
4,187,173 A * 2/1980 Keefer ..... 210/136
4,419,776 A * 12/1983 Schmidt ..... 4/564.1
5,157,797 A * 10/1992 Forwick ..... 4/566.1
5,377,366 A * 1/1995 Boyd et al. ..... 4/561.1
5,555,575 A * 9/1996 Anscombe-Black et al. . 4/563.1

FOREIGN PATENT DOCUMENTS

GB 2234491 A * 2/1991 ..... 4/560.1

* cited by examiner

*Primary Examiner*—David J. Walczak
*Assistant Examiner*—Tuan Nguyen

(57) ABSTRACT

An elevating bath lift seat for assisting elderly and disabled persons to safely get down into, and back out of a bathtub. it comprises a vertically moving seat surface supported by frame structure designed to be situated within most residential bathtubs. It uses household water pressure to elevate and lower the user. Lifting force is provided by a novel lifting bladder arrangement which is totally sealed without the use of sliding type seals. An integral part of the design is a novel frame structure that also serves as a linear guide system for up and down travel of the seat frame, while also providing full water immersion lubrication for linear guide bushings.

17 Claims, 5 Drawing Sheets

ELEVATING BATH LIFT SEAT FOR ELDERLY AND DISABLED PERSONS

BACKGROUND

1. Field of the Invention

This invention relates to relates to a bath lift seat arrangement to assist elderly and disabled persons while transferring into or out of a bathtub, and specifically, to help lower a person down into a bathtub for a full immersion bath, and then following the bath to lift the person up to a height higher than the edge of the bathtub.

2. Description of Prior Art

Entering and exiting from a typical bathtub may be a difficult process for some elderly or disabled persons. Particularly, rising up from a seated position down within a bathtub requires considerable strength, balance and range of motion which may be limited in some by a disability or effects of aging.

However, one solution is to provide a seating surface onto which the bather may sit, whereby the seating surface may be lowered and elevated by powered means, leaving the user with the lesser tasks of managing to transfer on to and off of the seating surface to take a full immersion bath. This function has been presented in prior art devices which are popularly referred to as bath lifts.

While various bath lift devices have been available in the prior art, these bath lifts suffer from several shortcomings relating to performance, weight and cost. Most of the prior art devices are cumbersome and heavy to lift due to large frame structures making it difficult for other bathtub users to remove the device from the bathtub when not needed. Some prior art devices have water powered type linear actuators employing rubber type sliding seals that tend to wear out, leak, or stick when allowed to run dry for a period of time. Further, many existing art bath lift seats give the user an unstable feeling in the elevated seat position due to design limitations which permit considerable rocking motions of the seat. Additionally, the complex nature of many of the existing bath lifts result in a prohibitively high cost for many individuals who could otherwise benefit from a bath lift device.

A major complaint of existing art bath lift seats is that the horizontal portion of the seat surface is only able to lower to within three to four inches of the bath tub floor surface due to the lifting mechanisms, seat guides, and frame structure being located below the seat surface. This results in an incomplete immersion bathing experience for those persons who could most benefit from complete submersion bathing, and also results in a considerable amount of water wastage during the life of the bath lift device.

The present bath lift device is unique in that it addresses the well known shortcomings of the current bath lifts. The present bath lift features a simple design minimizing structure for light weight, and hence ease of lifting and moving. It is also extremely stable in its raised position due to the secure linear seat guidance system. Further, the design allows for an extremely low seat bottom height to allow the bather to sit within under one inch of the floor of the bathtub. The unique lifting bladders offer smooth lifting without the use of sliding type seals which are prone to leakage.

SUMMARY OF THE INVENTION

According to the present invention, the elevating bath lift seat comprises the following major assemblies: the base frame assembly, the seat frame assembly, the lift bladders, the control pendant, and the manifold assembly.

In operation, the seat frame assembly is supported by the base frame and is moved upward and downward guided by the mast tubes of the base frame powered by a pressurized fluid such as domestic water pressure applied to the lift bladders. The lift bladders extend and retract to move the seat surface upward and downward. The flow of water to the bladders is guided by the control pendant and distributed through the manifold assembly.

Other objects, features and versions of the present invention will become apparent from the following detailed description, which, when interpreted with the listed drawings, together disclose a preferred embodiment of the invention. It is to be understood that the drawings are intended for the purpose of illustration only, and are not intended as a definition of the limits of the invention.

DETAILED DESCRIPTION OF THE PREFERRED EMBODIMENT

Figure 1:
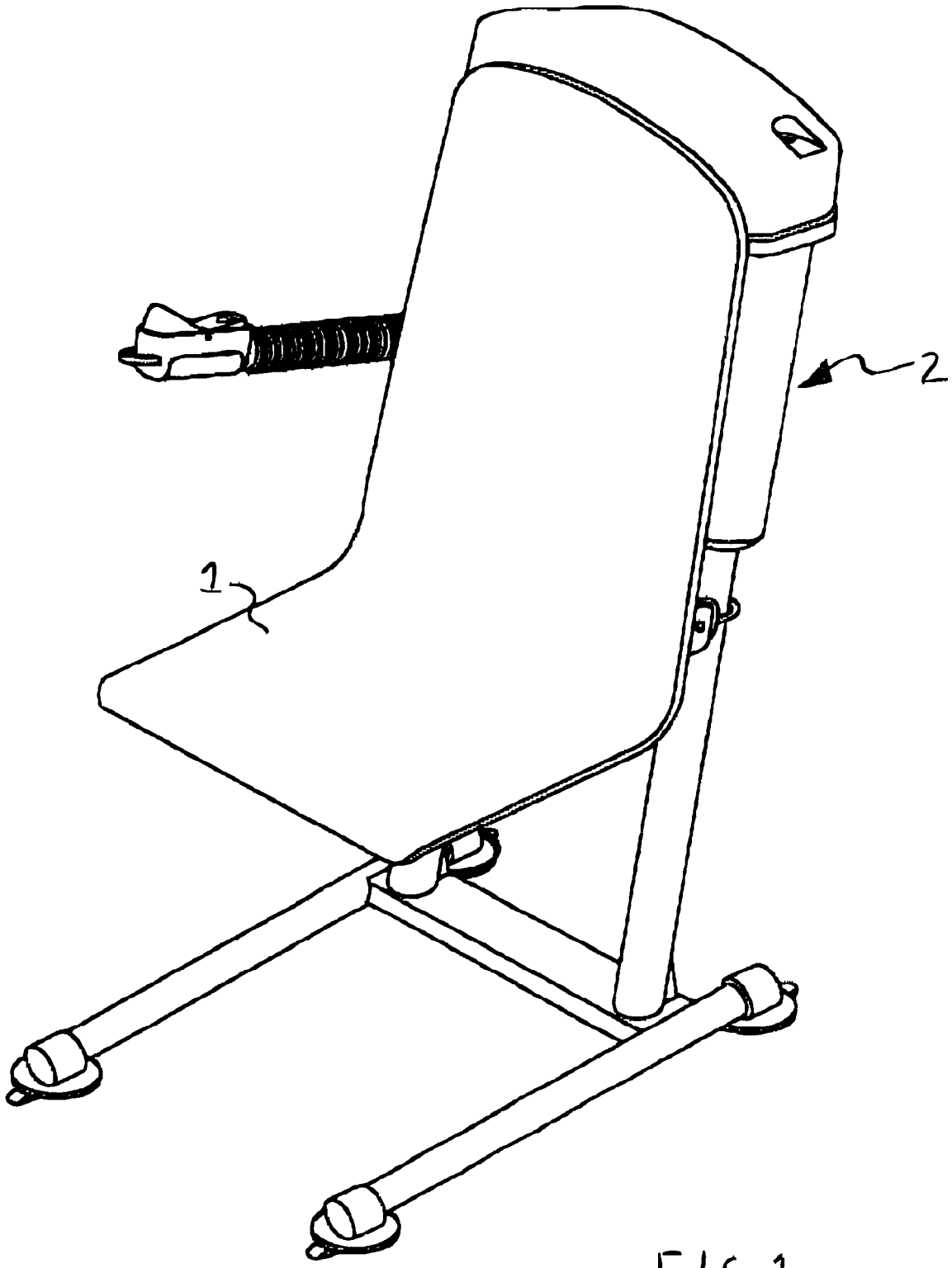
FIG. 1 is a perspective view of one embodiment of the present invention with the seat surface in the elevated position.
Figure 2:
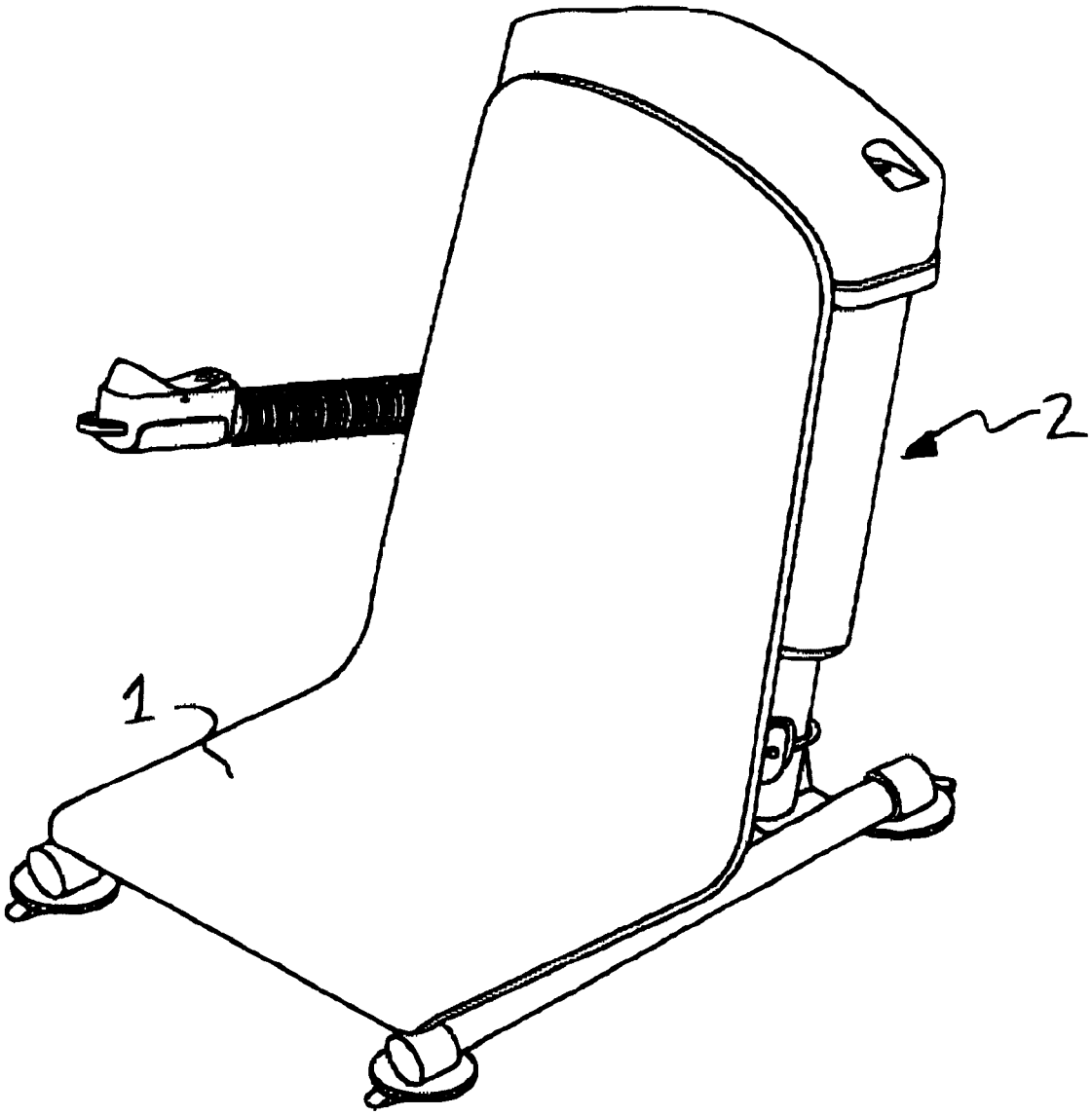
FIG. 2 is a perspective view of one embodiment of the present invention. with the seat surface in the lowest position.

Referring now to the figures, FIG. 1 illustrates one embodiment of the present invention showing the seat surface 1 in the uppermost position. FIG. 2 shows the bath lift seat 2 with the seat surface 1 in the lowermost position.

Figure 3:
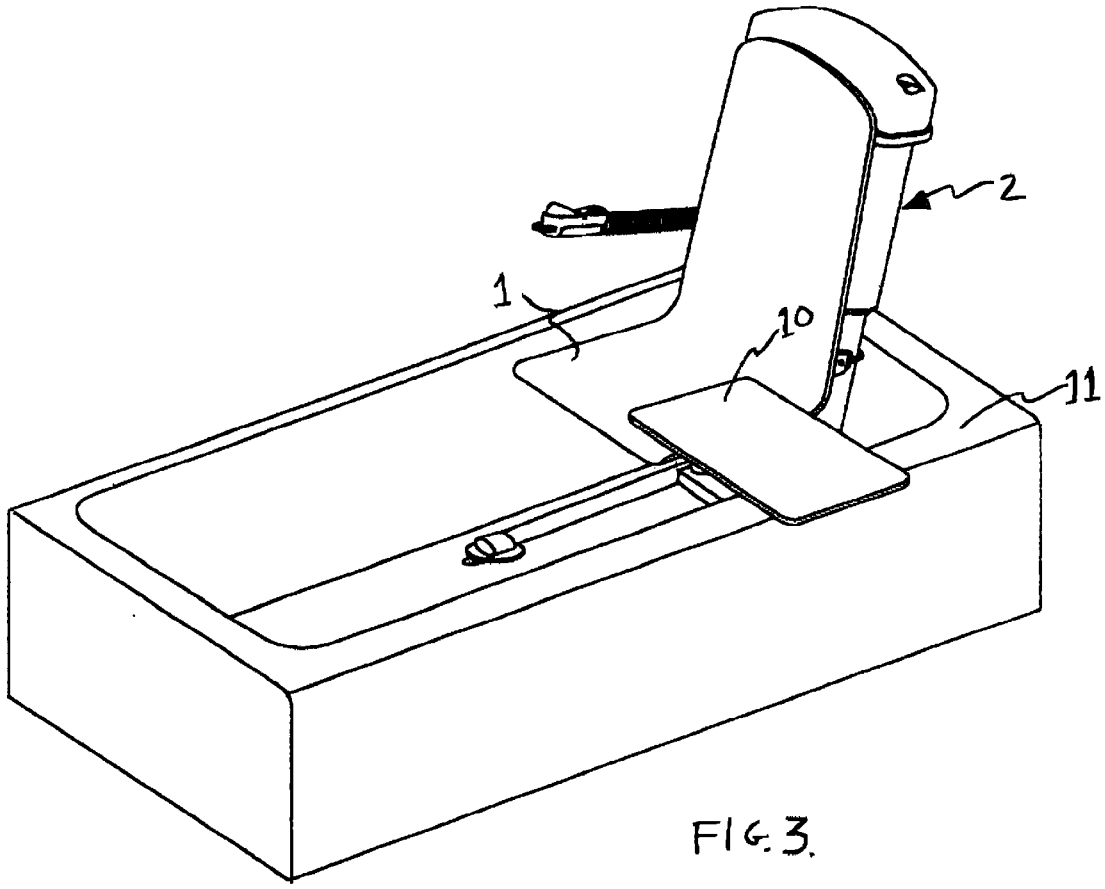
FIG. 3 is a perspective view of one embodiment of the present invention as placed in a typical bathtub with user transfer plate.

FIG. 3 shows the bath lift seat 2 as typically placed within a typical bathtub with the seat surface 1 in an elevated position. FIG. 3 also shows an optional planar member 10 used to span across from the seat surface 1 to the edge of the bathtub 11 to provide a surface for users to slide thereon to safely transfer to and from the seat surface 1.

Figure 4:
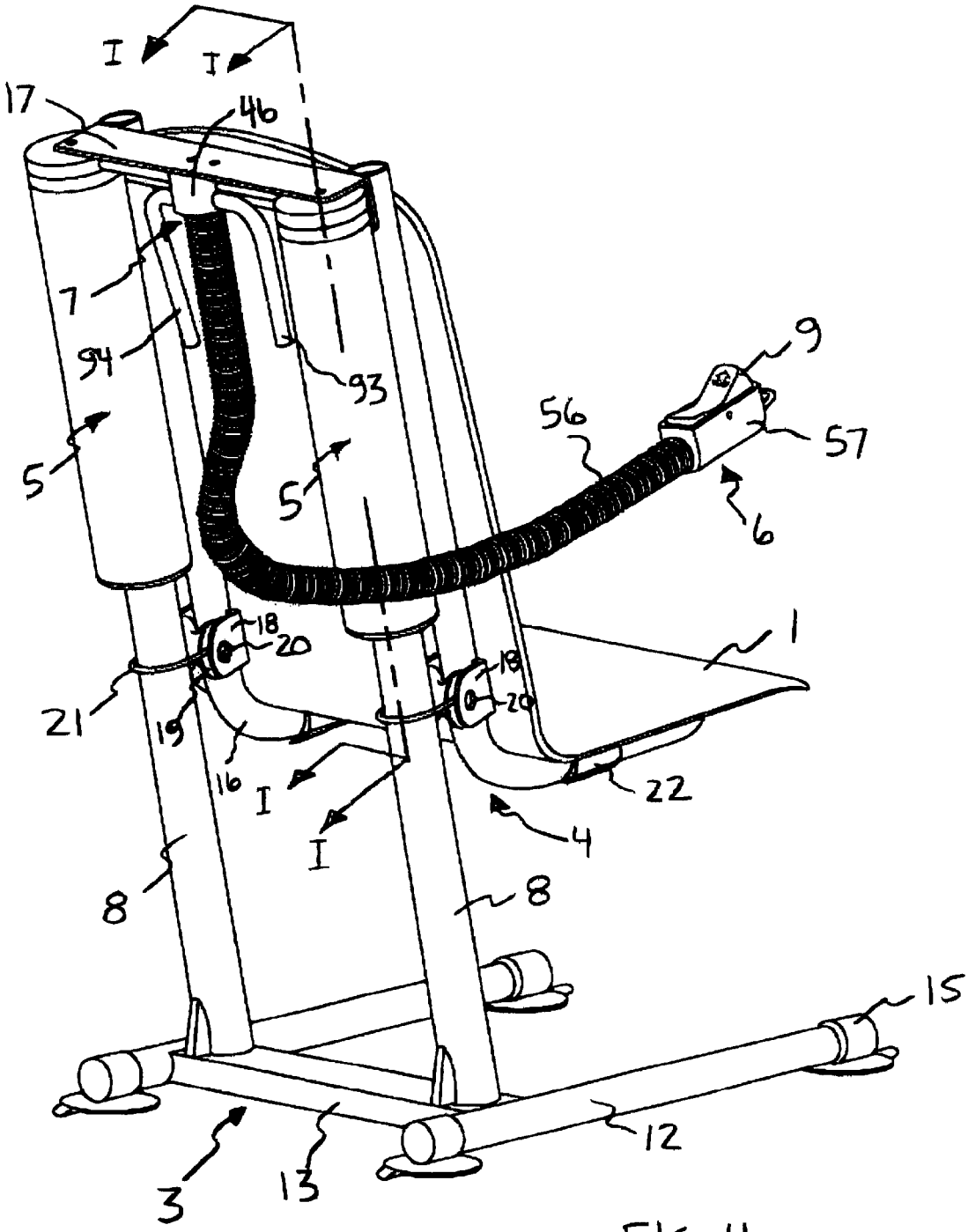
FIG. 4 is a rear perspective view of one embodiment of the present invention.

FIG. 4 shows a rear view of one embodiment with a top decorative cover removed for clarity.

Referring to FIG. 4, the bath lift seat comprises the following major assemblies: the base frame assembly 3, the seat frame assembly 4, the lift bladders 5, the control pendant 6, and manifold assembly 7.

Referring to FIG. 4, the seat frame assembly 4, is supported by the base frame 3, and is moved upward and downward guided by the mast tubes 8, of the base frame 3, using a pressurized fluid such as domestic water pressure applied to the lift bladders 5. The lift bladders 5 extend as will be described herein, and move seat surface 1 upward. The flow of water. to the bladders 5, is guided by the position of the rocker 9 of the control pendant 6, and distributed through the manifold assembly 7. Pressurized water is supplied via the supply hose 93 (shown shortened for clarity), and water is exhausted via drain hose 94.

Turning now to better describe major subassemblies, the base frame assembly 3 shown in FIG. 4, is most preferably fabricated from tubular elements which are lightweight, strong, and resistant to corrosion such as aluminum, or stainless steel in the case of metal tubes, or appropriate plastics known to those skilled in the art. The base frame assembly 3 comprises specifically a pair of tubular side legs 12, situated parallel or slightly angled to each other, oriented substantially parallel to the bathtub floor, and joined by the cross beam 13, a tubular element welded between the side legs 12, onto which is welded the two mast tubes 8, which are hollow tubes situated parallel to each other, and on a slight backward angle as shown.

When fully assembled, both ends of the side legs 12 are covered with end caps 15 which are made from a resilient and flexible material such as rubber and may be fabricated with or without a suction cup feature integrated into the bottom edge of the end caps 15 (not shown). Furthermore, the side legs 12 of the base frame assembly 4 are additionally sealed against water entry while in service by the insertion of plastic end plugs (not shown) inserted within the bore of each end of the side legs 12. In service, the end caps 15 are intended to be located over user installed friction pads (not shown) installed on the floor surface of the bathtub to prevent motion of the bath lift 2 within the bathtub while in use.

Referring to FIG. 4 the seat frame assembly 4, comprises the seat frame member 16, preferably fabricated from a formed single piece of lightweight tube such as aluminum, with a horizontal frame member 17, joined. thereon, spanning across the top ends of the seat frame member 16.

Referring to FIG. 4, also fixed onto the seat frame member 16 are roller support brackets 18, which hold the roller 19 which is fabricated from a lightweight material such as plastic and has a profile to match and roll on the front cylindrical surface of the mast tubes 8. The roller 19, has a centrally located cylindrical hole to receive roller shaft 20 which is fabricated from a corrosion resistant metal, such as stainless steel, and held in place with means known to those skilled in the art such as a circle clip or press fit end cap to prevent side ward motion of the roller shaft 20 while in use.

Furthermore, a curved rod member 21, such as a wireform, covered with a sleeve of a low friction material, is secured with ends pivotally mounted on roller shaft 20, and located such that the curved member is situated around the opposite side of the mast 8 relative to the roller 19.to prevent the seat frame assembly 4, and roller 19, from pulling away from the mast tube 8 should a lateral or forward force be exerted on the seat frame assembly 4.

Referring to FIG. 4, a seat surface 1, is secured to the seat frame member 16, using formed clamps 22, which wrap around the seat frame member 16 and are held to the underside of the seat surface 1, with an appropriate adhesive known to those skilled in the art. Seat surface is fabricated from a lightweight corrosion resistant material such as plastic and is formed with a profile to best interface with the body of an average user, advantageously whereby the horizontal portion of the seat is formed with a profile to situate the user closer to the floor of the bathtub when the seat frame assembly 4, is at its lowest position.

Figure 5:
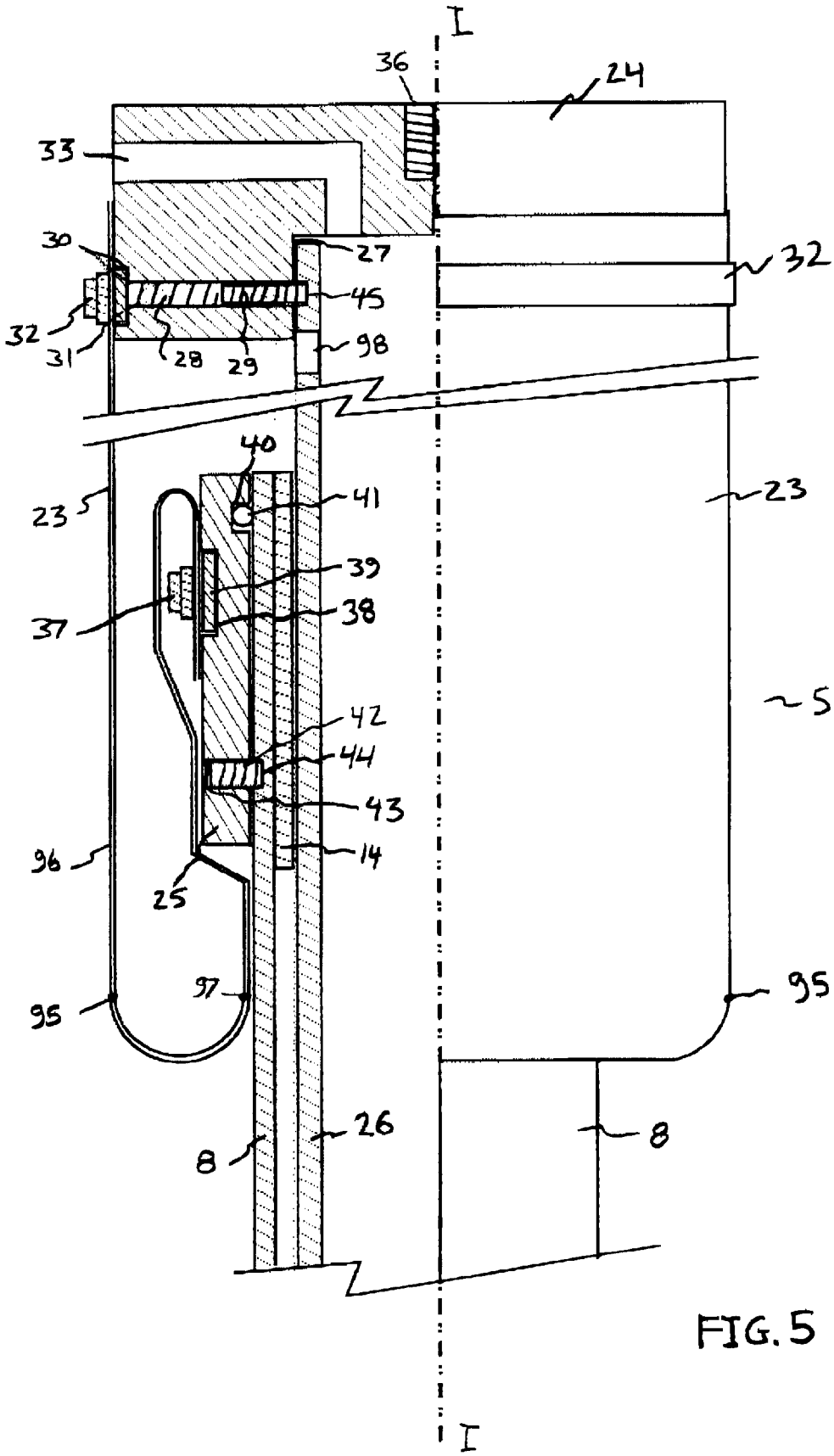
FIG. 5 is a section view I—I of one of the lift bladders as detailed in FIG. 4. of the present invention.

Referring to FIG. 4 and FIG. 5, the lift bladders 5 are effectively linear actuators which extend under the application of fluid pressure, and shorten when the fluid contained within is able to exhaust to atmosphere as directed by control pendant 6 and user.

FIG. 5 shows a partial section view I—I of one of the mast tubes 8 with lift bladders 5 mounted coaxially thereon. Mounted within each of the mast tubes 8, are guide bushings 14, made of a low surface friction material compatible with water immersion and considerable lateral force. Guide bushings 14, are interference press fit into their corresponding locations within the mast tube 8, and further held in place with an adhesive. The bore of the guide bushing 14 has a number of narrow longitudinal slots with the intent to reduce weight, cost, permit better water flow along the length of the mast, and permit shrinkage of the outside diameter of the guide bushing 14 when inserted inside the bore of mast 8.

The lift bladders 5, comprise the following major items: Clamp cap 24 serves as the top end and seal of the lift bladder 5. Clamp sleeve 25 serves as the bottom end seal of the lift bladder 5, while also sealing onto the top end of the mast tubes 8. Telescopic tube 26 is fixed within clamp cap 24, and is set slidably within guide bushing 14 of mast tube 8.

More specifically, the clamp cap 24, is functionally the top of the lift bladder and is constructed from a lightweight corrosion resistant material such as a plastic. Referring to FIG. 5, it comprises a bore 27, to receive the top end of the telescopic tube 26, with horizontally oriented threaded hole 28 to allow installation of set screw 29. In addition it has a sealing groove 30, in which is located an elastomeric band 31 which stores tension from the cylindrical hose clamp 32 to better seal the relatively thin lift bladder material 23. The clamp cap 24 also has a inlet aperture 33 which allows fluid in to the lift bladders 5 via a 90 degree bend down into bore 27. The top of the clamp cap 24 has means to allow fastening to the horizontal seat frame member 17 such as a threaded hole 36 for a threaded fastener. The bladder material 23 is a resilient, reinforced membrane such as an elastomeric coated fabric formed into a cylindrical shaped tube with two open ends. The bladder material 23 is able to withstand fluid such as water under pressure without leakage, and flexible enough to repeatedly roll inward moving telescopically within itself during extension and retraction of the lift bladders 5.

The clamp sleeve 25 is fabricated from a lightweight corrosion resistant material such as plastic and comprises a sealing groove 38 to act as a seat for the elastomeric band 39 as well as a groove 40 in which is located o-ring 41 which is intended in operation to seal against the top end of mast tube 8 to prevent leakage of water out of the pressurized environment inside the lift bladder. The clamp sleeve 25 is secured to the top end of mast tube 8 by set screw 42, held within a threaded hole 43 and engages into dimple 44 in mast tube 8.

The bladder material 23 is clamped at its bottom end using a hose clamp 37 acting on the clamp sleeve 25. The clamp sleeve has a smaller outer diameter compared to that of the clamp cap 24. Therefore, the bladder material 23 may have a larger diameter than that of the clamp sleeve 25. and will need pleated folds at the location of the clamp sleeve 25 in a manner to make a proper seal. To better seal the area of the pleated folds, the inside surface of the bladder material 23, and outside surface of the clamp sleeve 25, are covered with an appropriate adhesive sealant known to those skilled in the art to provide a leak tight seal at the area of the pleated folds and hose clamps 37.

Telescopic tube 26, is a tubular element made from a lightweight and strong material such as aluminum. In the case of aluminum, the surface must be treated to improve its wear resistance and corrosion resistance. Referring to FIG. 5, at the top end of the telescopic tube 26, is a shallow dimple 45, allowing the seating of a set screw 29, to secure the telescopic tube 26 within the bore 27 of the clamp cap 24. Aperture 98 permits air trapped in the top of the bladder to flow into the inside of telescopic tube 26 to drain out through inlet aperture 33 in the case of water used as the pressurized fluid.

The lift bladders 5 comprise bladder material 23, which is substantially cylindrical in shape and sealed at both ends, whereby the sealing means of the lower end is smaller in diameter than the inside diameter of the bladder material 23. This configuration permits the bladder material 23 to travel downward over the lower sealing means as shown in FIG. 5 which permits motion of the clamp cap 24 relative to mast 8 employing a totally sealed fluid vessel, without the detrimental use of sliding type rubber seals as used with piston and cylinder bore type linear actuators.

Therefore, to shorten the lift bladder 5, the control pendant 6 is activated to allow the fluid to flow out of the lift bladder 5. As a result, the clamp cap 24 and telescopic tube 26 moves downward whereby the telescopic tube 26 is confined to move downward axially within the guide bushing 14 within the mast 8. As the clamp cap 24 travels downward, the bottom leading edge 95 of the bladder material 23 is forced to coaxially roll inward towards the surface of the mast tube 8, such that it will ultimately cause what was the outward facing surface 96 of the bladder material 23, to be facing inward against the outer surface of the mast tube 8 as the clamp cap 24 continues to travel downward.

Also referring to FIG. 5, to extend the lift bladder 5, upon application of fluid pressure, the clamp cap 24 is forced to move upward, and bladder material 23 is pulled away from the mast tube 8, such the bladder material at the position Indicated by point 97 would coaxially fold outward to the position indicated by point 95.

Telescopic tube 26, is a tubular element made from a lightweight and strong material such as aluminum. In the case of aluminum, the surface must be treated to improve its wear resistance and corrosion resistance. Referring to FIG. 5, at the top end of the telescopic tube 26, is a shallow dimple 45, allowing the seating of a set screw 29, to secure the telescopic tube 26 within the bore 27 of the clamp cap 24. Aperture 98 permits air trapped in the top of the bladder to flow into the inside of telescopic tube 26 to drain out through inlet aperture 33 in the case of water used as the pressurized fluid.

The lift bladders 5 comprise bladder material 23, which is substantially cylindrical in shape and sealed at both ends, whereby the sealing means of the lower end is smaller in diameter than the Inside diameter of the bladder material 23. This configuration permits the bladder material 23 to travel downward over the lower sealing means as shown in FIG. 5 which permits motion of the clamp cap 24 relative to mast 8 employing a totally sealed fluid vessel, without the detrimental use of sliding type rubber seals as used with piston and cylinder bore type linear actuators.

Therefore, to shorten the lift bladder 5, the control pendant 6 is activated to allow the fluid to flow out of the lift bladder 5. As a result, the clamp cap 24 and telescopic tube 26 moves downward whereby the telescopic tube 26 is confined to move downward axially within the guide bushing 14 within the mast 8. As the clamp cap 24 travels downward, the bottom leading edge 95 of the bladder material 23 is forced to coaxially roll inward towards the surface of the mast tube 8, such that it will ultimately cause what was the outward facing surface 96 of the bladder material 23, to be facing inward against the outer surface of the mast tube 8 as the clamp cap 24 continues to travel downward.

Also referring to FIG. 5, to extend the lift bladder 5, upon application of fluid pressure, the clamp cap 24 is forced to move upward, and bladder material 23 is pulled away from the mast tube 8, such the bladder material at the position indicated by point 97 would coaxially fold outward to the position indicated by point 95.

Referring to FIG. 4, the manifold assembly 7, comprises manifold block 46, and Various hoses secured thereto. Manifold block 46, is fabricated from a lightweight and corrosion resistant material such as plastic.

The control pendant 6 is fabricated from a lightweight corrosion resistant material such as a plastic. It comprises a pendant body 57 and rocker 9 and a plurality of valve assemblies contained within of a type known to those skilled in the art. The control pendant is connected to a manifold block 46 by three hoses contained within flexible sleeve 56. In operation, the control pendant 6 acts as a two way, three position, spring return to center valve system to control flow of water in and out of the lift bladders.

For control of the fluid flow to and from the bladders 5, the rocker 9 has three positions; in center (non-actuated) position, the control pendant 6 permits no flow to or from the bladders 5. When the rear rocker surface is pressed downward, the control pendant 6 permits flow to bladders 5 from pressure source thereby elevating the seat surface 1. When the front rocker surface is pressed, flow is permitted from lift bladders to drain thereby lowering the seat surface.

Although the invention has been described relating to a preferred embodiment, it should be understood that various modifications, additions, and alterations may be made to the invention by one skilled in the art without departing from the spirit and scope of the invention as defined in the appended claims.

What claimed is:

1. A bath lift device for assisting disabled persons into and out of a bathtub comprising a seat mounted on a seat frame which is moved up and down by a cylindrical telescoping arcuate moving lift bladder arrangement having a membrane coaxially rolling in itself having an inner end and an outer end, wherein the inner end of the membrane is sealingly attached to a mast tube of the device and the outer end of the membrane is sealingly attached to a clamp cap of the device and powered by a source of fluid pressure.

2. A bath lift device according to claim 1 wherein the lift bladder arrangement comprises a pair of lift bladders.

3. A bath lift device according to claim 2 wherein the lift bladders are connected to a fluid distributing manifold.

4. A bath lift device according to claim 3 wherein a manually controlled pendant controls the seat motion.

5. A bath lift device according to claim 4 wherein the seat frame is supported on a base frame.

6. A bath lift device according to claim 5 wherein the base frame has a pair of mast tubes attached thereto.

7. A bath lift device according to claim 6 wherein the seat frame has a pair of roller support brackets each of which carry a roller adapted to move on the mast tube.

8. A bath lift device for assisting disabled persons into and out of a bathtub comprising a base frame having a pair of hollow mast tubes extending in a substantially vertical direction and a seat frame member moveably attached to the hollow mast tubes by a horizontal frame member which retains a pair of bladder clamp caps with a guide tube held by each clamp cap wherein the guide tubes move telescopically in the mast tubes by means of a lift balder arrangement connected to a fluid distributing manifold using a source of fluid pressure to move the seat up or down and controlled by a control pendant.

9. A bath lift device according to claim 8 wherein the seat frame member has a pair of roller support brackets each having a roller adapted to move on the mast tube.

10. A bath lift device according to claim 9 wherein each of the support brackets retain a secondary roller set adapted to move on the mast tube.

11. A bath lift device according to claim 10 wherein the lift bladder arrangement has a pair of lift bladders.

12. A bath lift device according to claim 11 wherein each lift bladder is retained by a bladder clamp cap and a clamp sleeve which is concentric on each mast tube.

13. A bath lift device according to claim 12 wherein each mast tube has a guide bushing mounted therein.

14. A bath lift device according to calm 13 wherein the control pendant utilizes a control lever.

15. A bath lift device according to claim 13 wherein the control pendant utilizes a rocker type actuating member.

16. A lift bladder for a bath lift device comprising a cylindrical telescopic arcuate moving membrane coaxially rolling in itself having an inner end and an outer end wherein the inner end of the membrane is sealingly attached to a mast tube of the device and the outer end of the membrane is sealingly attached to a clamp cap of the device and a passageway in the clamp cap allows a source of fluid pressure to actuate the bladder.

17. A lift bladder according to claim 16 wherein the lift bladder is clamped at the inner end and outer end with a resilient elastomeric material and a clamping band.

* * * * *